US012680187B2

(12) United States Patent
Ishii et al.

(10) Patent No.: US 12,680,187 B2
(45) Date of Patent: Jul. 14, 2026

(54) PLATING APPARATUS

(71) Applicant: EBARA CORPORATION, Tokyo (JP)

(72) Inventors: Tsubasa Ishii, Tokyo (JP); Masashi Shimoyama, Tokyo (JP); Masashi Obuchi, Tokyo (JP); Koichi Masuya, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 642 days.

(21) Appl. No.: 18/086,319

(22) Filed: Dec. 21, 2022

(65) Prior Publication Data

US 2023/0279579 A1 Sep. 7, 2023

(30) Foreign Application Priority Data

Mar. 1, 2022 (JP) ..... 2022-030876

(51) Int. Cl.
*C25D 21/12* (2006.01)
*C25D 17/00* (2006.01)
*C25D 17/06* (2006.01)

(52) U.S. Cl.
CPC ..... *C25D 21/12* (2013.01); *C25D 17/007* (2013.01); *C25D 17/06* (2013.01)

(58) Field of Classification Search
CPC ..... C25D 21/12
See application file for complete search history.

(56) References Cited

U.S. PATENT DOCUMENTS 7,578,920 B2 * 8/2009 Noji ..... C25F 7/00 205/147
2005/0173250 A1 8/2005 Thies et al.
2006/0289299 A1 * 12/2006 LeBlanc ..... G01N 27/42 204/229.8
2015/0008132 A1 * 1/2015 Stahl ..... G01N 27/4166 204/229.8
2016/0298256 A1 * 10/2016 Thorum ..... C25D 21/12

FOREIGN PATENT DOCUMENTS

| | | | |
|---|---|---|---|
| JP | 2002-105695 | A | 4/2002 |
| JP | 2005-536633 | A | 12/2005 |
| JP | 2007-270320 | A | 10/2007 |
| JP | 2008-019496 | A | 1/2008 |
| JP | 6937974 | B1 | 9/2021 |
| WO | WO 2022/190243 | A1 | 9/2022 |

OTHER PUBLICATIONS

English translation JP2007270320 (Year: 2007).*

* cited by examiner

*Primary Examiner* — Stefanie S Wittenberg
(74) *Attorney, Agent, or Firm* — BakerHostetler

(57) ABSTRACT

Provided is a plating apparatus capable of improving uniformity of a plating film formed on a substrate. The plating apparatus includes a plating tank, a substrate holder that holds a substrate, and an anode disposed in the plating tank to oppose the substrate held by the substrate holder. The plating apparatus also includes a conduit having a first portion including an opening end disposed in a region between the substrate held by the substrate holder and the anode, and a second portion apart from the region between the substrate held by the substrate holder and the anode, the conduit having at least a part filled with a plating solution, and a potential sensor that is disposed in the second portion of the conduit and that is configured to measure a potential of the plating solution.

12 Claims, 9 Drawing Sheets

1000

PLATING APPARATUS

CROSS REFERENCE TO RELATED APPLICATION

This application claims priority to Japanese Patent Application No. 2022-030876 filed Mar. 1, 2022, the entire contents of which are hereby incorporated by reference.

TECHNICAL FIELD

The present application relates to a plating apparatus.

BACKGROUND ART

As an example of a plating apparatus, a cup type electrolytically plating apparatus is known (see, for example, PTL 1). In the cup type electrolytically plating apparatus, a substrate (for example, a semiconductor wafer) held by a substrate holder with a surface to be plated being oriented downward is immersed into a plating solution, and a voltage is applied between the substrate and an anode, thereby precipitating a conductive film on a substrate surface.

In the plating apparatus, generally, a user sets in advance parameters, such as a plating current value and a plating time, as plating process recipes, based on a target plating film thickness and an actual plating area of a substrate on which a plating process is performed, and the plating process is performed based on the set process recipes (see, for example, PTL 2). Then, the plating process is performed on a plurality of wafers on the same carrier with the same process recipe. Also, to measure the plating film thickness after the plating process, in general, after the plating process of all the wafers in the carrier ends, the carrier containing the wafers is transferred from the plating apparatus to a separate film thickness measuring device, and film thicknesses and wafer in-plane profiles are individually measured.

CITATION LIST

Patent Literature

PTL 1: Japanese Patent Laid-Open No. 2008-019496
PTL 2: Japanese Patent Laid-Open No. 2002-105695

SUMMARY OF INVENTION

Technical Problem

In a plating apparatus, when a plating process is performed on substrates in the same carrier on the same process conditions, variations might be generated in film thickness of a plating film formed on each substrate, due to dimensional tolerance of the substrate, change in state of a plating solution in a plating tank, or the like. Further, when an average film thickness is adjusted for a plurality of substrates, variations might be generated in plating film thickness depending on a location in the same substrate.

In view of the above-described actual situations, one object of the present application is to provide a plating apparatus capable of improving uniformity of a plating film formed on a substrate.

Solution to Problem

According to an embodiment, a plating apparatus is provided, and the plating apparatus includes a plating tank, a substrate holder that holds a substrate, an anode disposed in the plating tank to oppose the substrate held by the substrate holder, a conduit having a first portion including an opening end disposed in a region between the substrate held by the substrate holder and the anode, and a second portion apart from the region between the substrate held by the substrate holder and the anode, the conduit having at least a part filled with a plating solution, and a potential sensor that is disposed outside the region of the conduit and that is configured to measure a potential of the plating solution.

According to another embodiment, a plating apparatus is provided, and the plating apparatus includes a plating tank, a substrate holder that holds a substrate, an anode disposed in the plating tank to oppose the substrate held by the substrate holder, a conduit having a first portion including an opening end disposed in a region between the substrate holder and the anode in the plating tank, and a second portion apart from the region between the substrate holder and the anode, the conduit having at least a part filled with a plating solution, and an auxiliary anode disposed in the second portion of the conduit.

DESCRIPTION OF EMBODIMENTS

Figure 1:
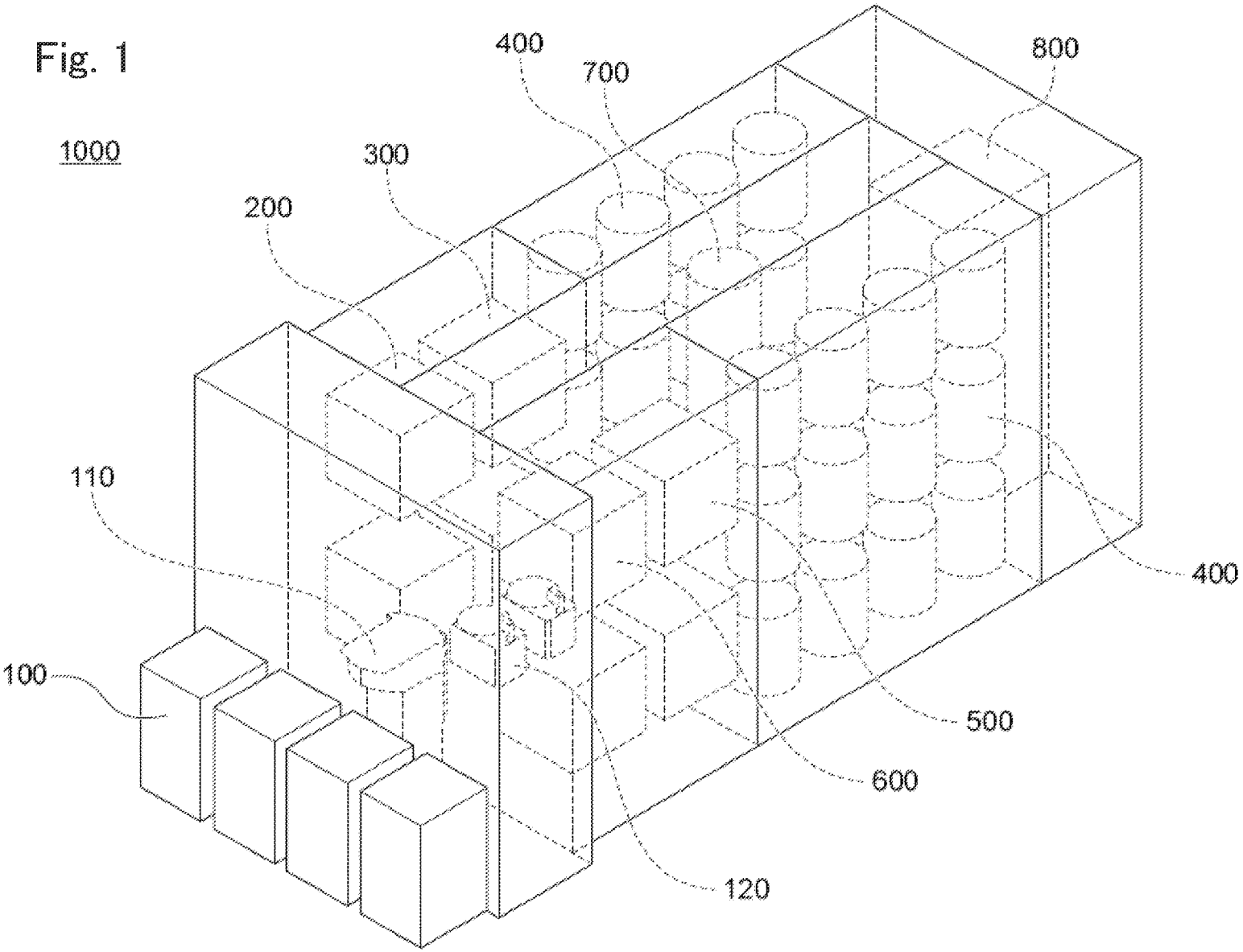
FIG. 1 is a perspective view illustrating an overall configuration of a plating apparatus of a first embodiment.

Hereinafter, embodiments of the present invention will be described with reference to the drawings. In the drawings described below, the same or corresponding components are denoted with the same reference sign and will not be described in duplicate.

First Embodiment

<Overall Configuration of Plating Apparatus>

Figure 2:
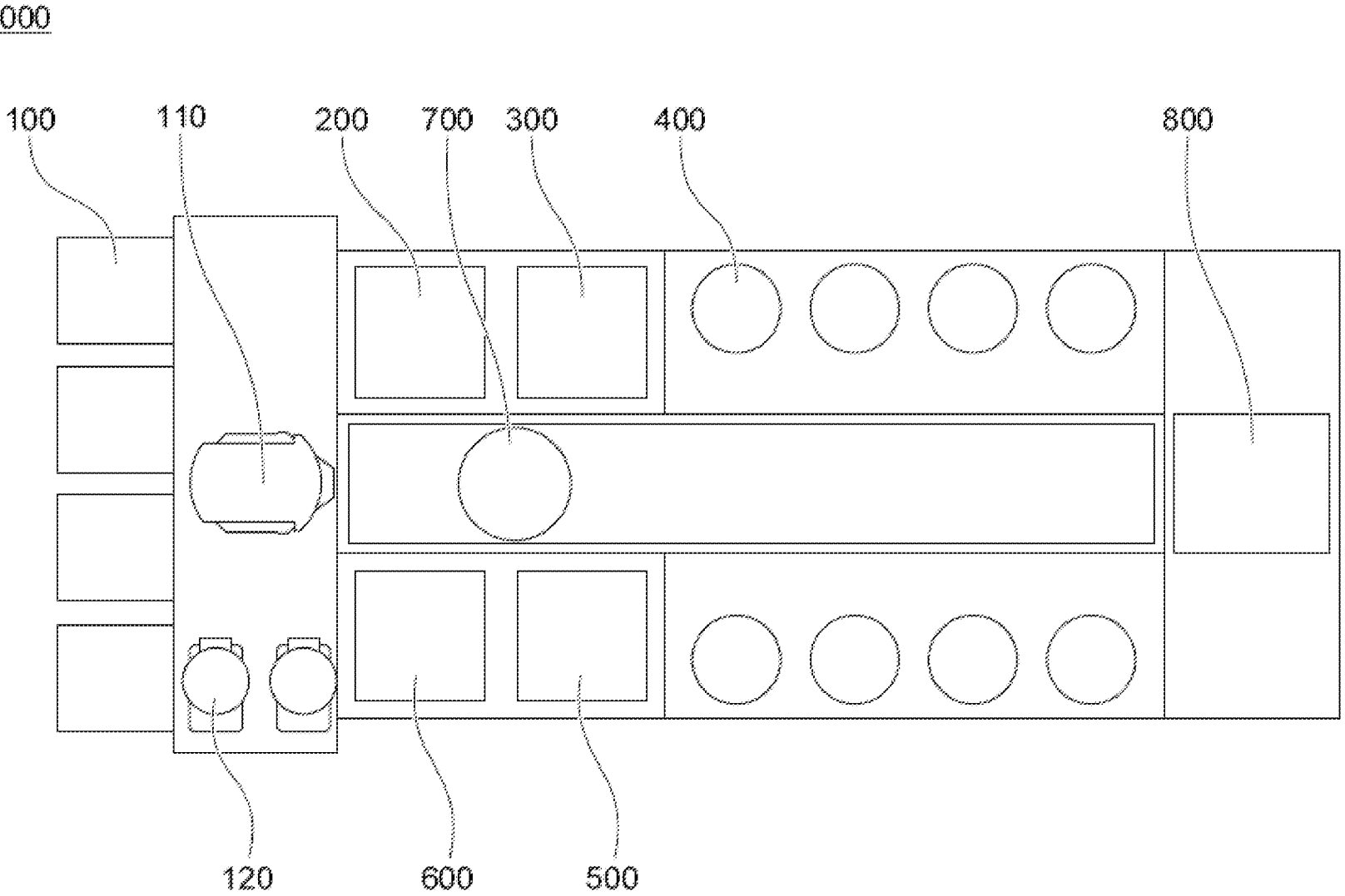
FIG. 2 is a plan view illustrating the overall configuration of the plating apparatus of the first embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary.

The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configuration of the plating apparatus 1000 described with reference to FIGS. 1 and 2 is merely an example, and the configuration of the plating apparatus 1000 is not limited to the configuration of FIGS. 1 and 2.

<Configuration of Plating Module>

Figure 3:
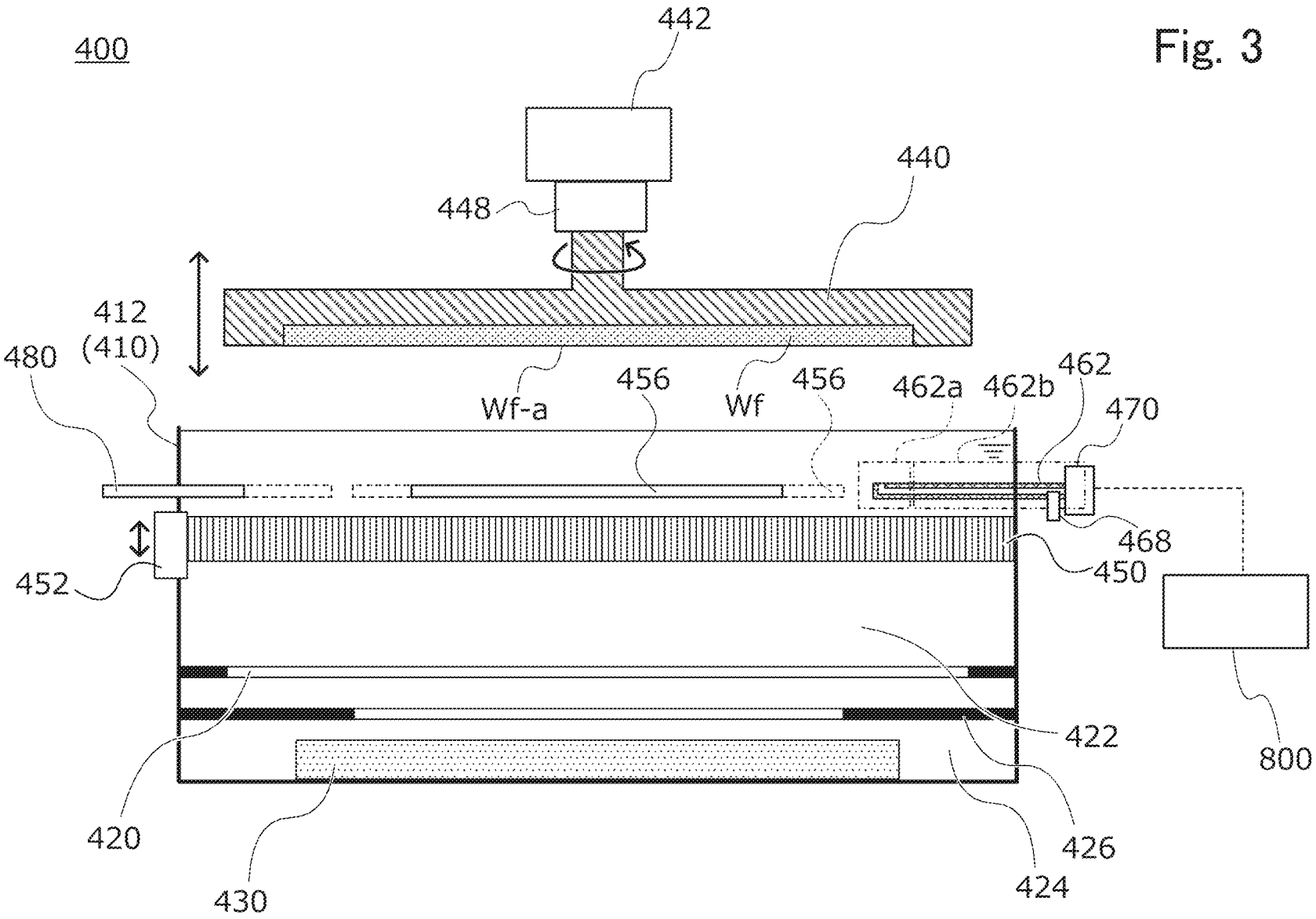
FIG. 3 is a longitudinal sectional view schematically illustrating a configuration of a plating module of the first embodiment.

Next, a configuration of the plating module 400 will be described. Since 24 plating modules 400 in the present embodiment have the same configuration, one plating module 400 alone will be described. FIG. 3 is a longitudinal sectional view schematically illustrating the configuration of the plating module 400 of the first embodiment. As illustrated in FIG. 3, the plating module 400 includes a plating tank 410 for storing a plating solution. The plating tank 410 includes a cylindrical inner tank 412 having an open upper surface, and an unillustrated outer tank provided around the inner tank 412 so that the plating solution overflowing from an upper edge of the inner tank 412 is accumulated.

The plating module 400 includes a substrate holder 440 that holds a substrate Wf with a surface to be plated Wf-a being oriented downward. The substrate holder 440 includes a power supply contact point to supply power from an unillustrated power supply to the substrate Wf. The plating module 400 includes an elevating/lowering mechanism 442 that elevates and lowers the substrate holder 440. Further, in one embodiment, the plating module 400 includes a rotation mechanism 448 that rotates the substrate holder 440 about a vertical axis. The elevating/lowering mechanism 442 and the rotation mechanism 448 can be achieved by a known mechanism such as a motor.

The plating module 400 includes a membrane 420 that separates an inside of the inner tank 412 in the vertical direction. The inside of the inner tank 412 is divided into a cathode region 422 and an anode region 424 by the membrane 420. The cathode region 422 and the anode region 424 are each filled with the plating solution. In the present embodiment, an example where the membrane 420 is provided is described, and alternatively, the membrane 420 need not be provided.

On a bottom surface of the inner tank 412 of the anode region 424, an anode 430 is provided. Also, in the anode region 424, an anode mask 426 for adjusting electrolysis between the anode 430 and the substrate Wf is disposed. The anode mask 426 is, for example, a substantially plate-shaped member made of a dielectric material and provided on a front surface of (above) the anode 430. The anode mask 426 has an opening through which a current flowing between the anode 430 and the substrate Wf passes. In the present embodiment, the anode mask 426 is configured to have a changeable opening dimension and the opening dimension is adjusted by the control module 800. Here, the opening dimension means a diameter when the opening is circular, and a length of a side or longest opening width when the opening is polygonal. To change the opening dimension in the anode mask 426, a known mechanism can be adopted. In the present embodiment, an example where the anode mask 426 is provided is described, and alternatively, the anode mask 426 need not be provided. Furthermore, the membrane 420 described above may be provided in the opening of the anode mask 426.

In the cathode region 422, a resistor 450 opposing the membrane 420 is disposed. The resistor 450 is a member for uniformly performing the plating process in the surface to be plated Wf-a of the substrate Wf. In the present embodiment, the resistor 450 is configured to be movable in an up-down direction in the plating tank 410 by a drive mechanism 452, and a position of the resistor 450 is adjusted by the control module 800. Alternatively, the plating module 400 need not include the resistor 450. While a specific material of the resistor 450 is not particularly limited, in a modification of the present embodiment, for example, a porous resin such as polyether ether ketone is used.

In a vicinity of the surface of the substrate Wf in the cathode region 422, a paddle 456 for stirring the plating solution is provided. The paddle 456 is made of, for example, titanium (Ti) or a resin. The paddle 456 reciprocally moves parallel to the surface of the substrate Wf, to stir the plating solution so that sufficient metal ions are uniformly supplied to the surface of the substrate Wf during the plating of the substrate Wf. The present invention is not limited to such an example, and the paddle 456 may be configured, for example, to move perpendicularly to the surface of the substrate Wf. Alternatively, the plating module 400 need not include the paddle 456.

The cathode region 422 is provided with a conduit 462. The conduit 462 is a hollow tube and can be made of a resin such as polypropylene (PP) or polyvinyl chloride (PVC) as an example. When the resistor 450 is provided in the cathode region 422, the conduit 462 may be provided between the substrate Wf and the resistor 450. Further, when the paddle 456 is provided, the conduit 462 may be disposed so as not to interfere with the paddle 456, and as an example, it is preferable that the conduit has the same height as the paddle 456 and is disposed on an outer peripheral side of the paddle 456 (in FIG. 3, outside a left-right direction).

Figure 4:
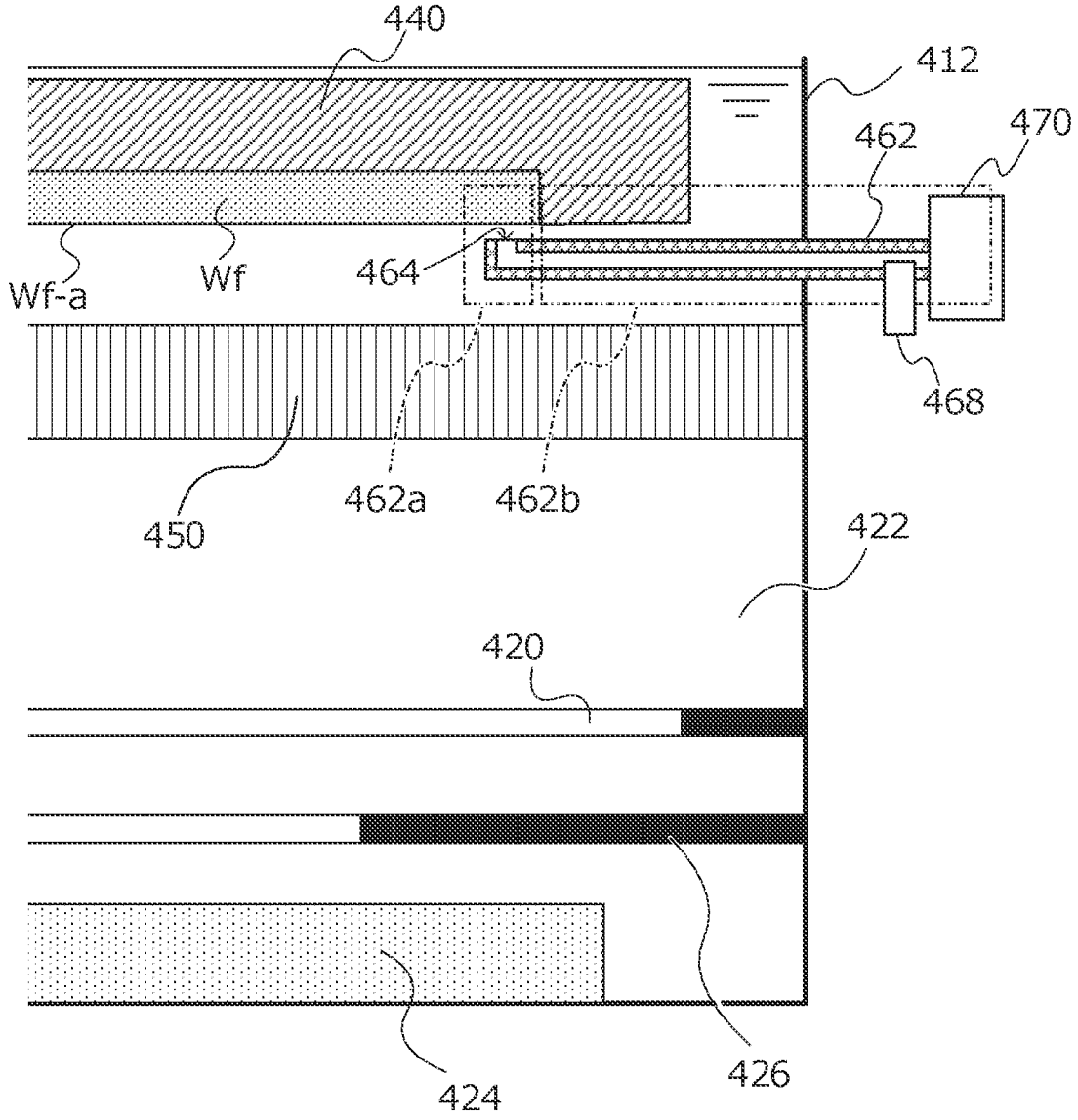
FIG. 4 is a schematic view illustrating an enlarged periphery around a conduit of the plating module of the first embodiment.

FIG. 4 is a schematic view illustrating an enlarged periphery around the conduit 462 of the plating module in the first embodiment. As illustrated in FIGS. 3 and 4, the conduit 462 has an opening end 464 disposed in a region between the substrate Wf and the anode 430. Specifically, the opening end 464 is located between the substrate Wf and the anode 430 in a direction perpendicular to a plate surface of the substrate Wf and is disposed at a position that overlaps with the substrate Wf seen from the direction perpendicular to the plate surface of the substrate Wf. The opening end 464 is preferably disposed close to the surface to be plated Wf-a, and is preferably configured to face the surface to be plated Wf-a. As an example, a distance between the opening end 464 and the surface to be plated Wf-a is several hundred micrometers, several millimeters, or tens of millimeters. Note that the opening end 464 may be opened in a direction perpendicular to a direction connecting the substrate Wf and the anode 430 (in FIGS. 3 and 4, in the left-right direction), or may be opened inclined toward the surface to be plated Wf-a of the substrate Wf. The conduit 462 extends to a region apart from the region between the substrate Wf and the anode 430, and in the present embodiment, extends outside the plating tank 410. Hereinafter, a portion disposed in the region between the substrate Wf and the anode 430 in the conduit 462 is referred to as "a first portion 462*a*", and a portion disposed in the region apart from the region between the substrate Wf and the anode 430 in the conduit is referred to as "a second portion 462*b*". The conduit 462 preferably extends from the direction connecting the substrate Wf and the anode 430 (the vertical direction in the present embodiment) to the perpendicular direction (the left-right direction in FIGS. 3 and 4). However, without limiting to such examples, the conduit 462 may extend in any direction.

The inside of the conduit 462 is filled with the plating solution in the same manner as in the cathode region 422. The conduit 462 may be provided with a filling mechanism 468 for filling the inside of the conduit 462 with the plating solution. As the filling mechanism 468, various known mechanisms can be adopted, and as an example, an air vent valve, a mechanism for supplying the plating solution, or the like can be adopted. The filling mechanism 468 is provided in the second portion 462*b* of the conduit 462 as an example.

While FIGS. 3 and 4 illustrate one conduit 462 for ease of seeing, a plurality of conduits 462 may be provided in the plating tank 410. When the plurality of conduits 462 are provided, the opening ends 464 of the respective conduits 462 may be arranged at different distances from a center of the substrate Wf. When the plurality of conduits 462 are provided, the opening ends 464 of the respective conduits 462 are preferably arranged at positions having an equal distance from the surface to be plated Wf-a of the substrate Wf.

In the second portion 462*b* of the conduit 462, a potential sensor 470 is provided. While the potential sensor 470 is disposed outside the plating tank 410 in FIGS. 3 and 4, the sensor may be disposed inside the plating tank 410. The potential sensor 470 detects a potential of the plating solution with which the conduit 462 is filled. Here, the plating solution in the conduit 462 has about the same potential as the plating solution at the opening end 464, and the detected potential by the potential sensor 470 is approximately equal to the potential of the plating solution at the opening end 462*a*. Therefore, the vicinity of the opening end 464 can be a pseudo potential detection position by the potential sensor 470, and the potential sensor 470 provided in the second portion 462*b* of the conduit 462 can measure a potential near the surface to be plated Wf-a. A detection signal by the potential sensor 470 is inputted into the control module 800.

Additionally, in the plating module 400, it is preferable to provide a potential sensor for reference (not illustrated) in a place of the plating tank 410 where there is relatively no change in potential, and to acquire a difference between a detected potential by the potential sensor for reference and a detected potential by the potential sensor 470. Since a change in potential difference measured by the potential sensor 470 is exceedingly small, the measurement is susceptible to noise. For reducing noise, it is preferable to install an independent electrode in the plating solution and connect the electrode directly to ground. In this case, it is further preferable to install at least five electrodes in the plating tank 410, that is, electrodes for a plating substrate (cathode), for an anode 430, for two potential sensors (the potential sensor 470 and the potential sensor for reference) and for grounding.

The control module 800 can calculate a plating formation rate of the surface to be plated Wf-a based on a detection value by the potential sensor 470. This is based on correlation between a plating current and potential in the plating process. A current plating film thickness can be estimated based on change, over time, in plating formation rate calculated from the start of plating. The estimation of a plating film thickness based on the potential detected by the potential sensor 470 can adopt a known technique. As an example, the control module 800 can estimate a distribution of the plating current in the substrate during the plating process based on the detection signal and estimate a film thickness distribution of the plating film in the substrate based on the estimated plating current distribution.

<End Point Detection and End Point Prediction>

The control module 800 may detect an end point of the plating process or may predict a time until the end point of the plating process, based on the detection value by the potential sensor 470. As an example, the control module 800 may end the plating process when the film thickness of the plating film reaches a desired thickness based on the detection value by the potential sensor 470. As an example, a film thickness measurement module may calculate a film thickness increase rate of the plating film and may predict a time until the desired thickness is reached, that is, the time until the end point of the plating process based on the detection value by the sensor 470.

<Shielding Body>

Figure 5:
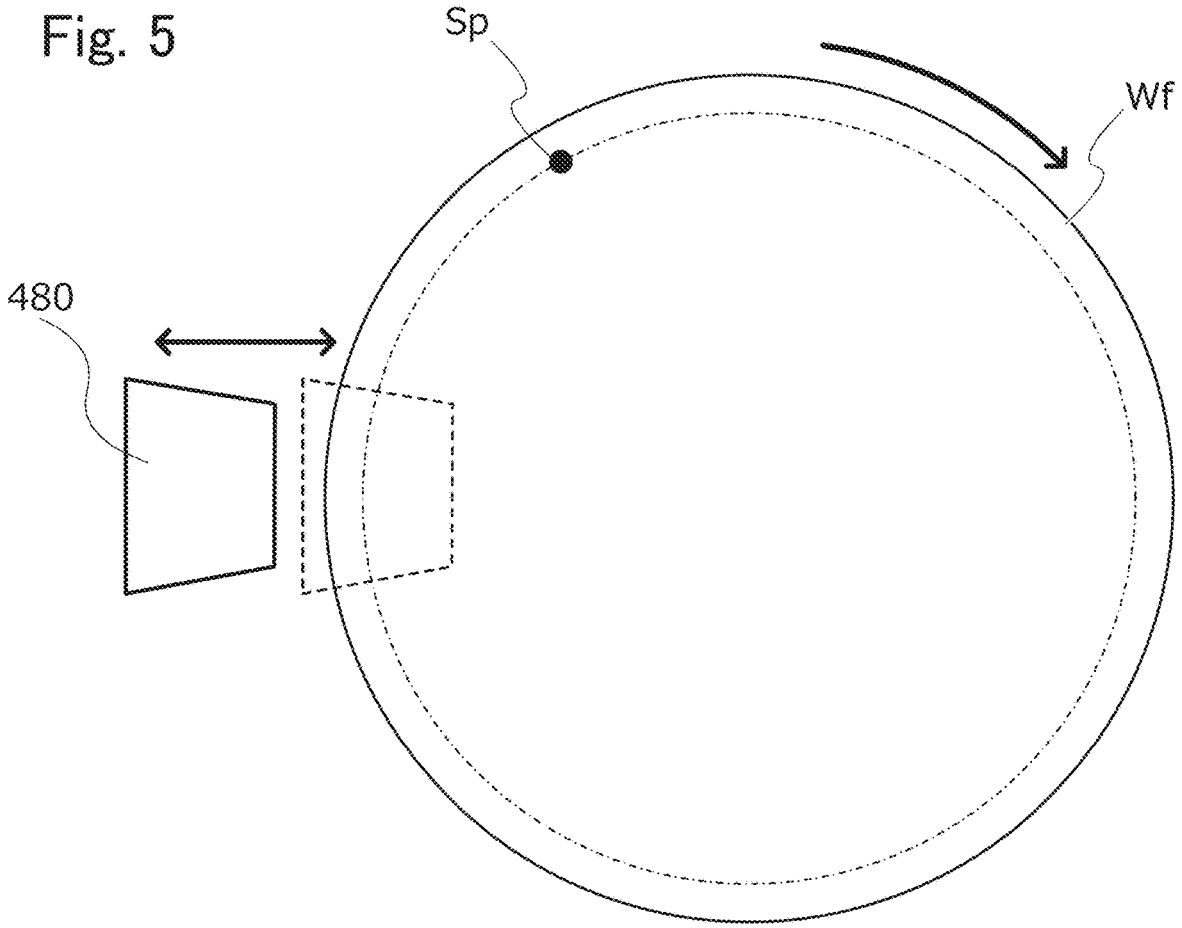
FIG. 5 is a schematic view of a shielding body and a substrate of the first embodiment seen from below.

Return to the description of the configuration of the plating module 400. As illustrated in FIG. 3, in one embodiment, in the cathode region 422, a shielding body 480 is provided for shielding the current flowing from the anode 430 to the substrate Wf. The shielding body 480 is, for example, a substantially plate-shaped member made of a dielectric material. FIG. 5 is a schematic view of the shielding body 480 and the substrate Wf of the present embodiment seen from below. FIG. 5 does not illustrate the substrate holder 440 that holds the substrate Wf. The shielding body 480 is configured to be movable to a shielding position (in FIGS. 3 and 5, the position indicated with a dashed line) interposed between the surface to be plated Wf-a of the substrate Wf and the anode 430, and a retracted position (in FIGS. 3 and 5, the position indicated with a solid line) retracted from a region between the surface to be plated Wf-a and the anode 430. In other words, the shielding body 480 is configured to be movable to the shielding position below the surface to be plated Wf-a and the retracted position apart from below the surface to be plated Wf-a. The position of the shielding body 480 is controlled by the control module 800 with an unillustrated drive mechanism. The movement of the shielding body 480 can be performed by a known mechanism such as a motor or solenoid. In the examples illustrated in FIGS. 3 and 5, the shielding body 480 shields a part of an outer peripheral region of the surface to be plated Wf-a of the substrate Wf in a circumferential direction at the shielding position. In the example illustrated in FIG. 5, the shielding body 480 is formed into a tapered shape that becomes thinner toward the center of the substrate Wf. However, without being limited to such examples, the shielding body 480 having any shape predetermined by experiments or the like can be used.

<Plating Process>

Next, the plating process in the plating module 400 of the present embodiment will be described in more detail. By immersing the substrate Wf in the plating solution of the cathode region 422 by use of the elevating/lowering mechanism 442, the substrate Wf is exposed to the plating solution. By applying a voltage between the anode 430 and the substrate Wf in this state, the plating module 400 can perform the plating process on the surface to be plated Wf-a of the substrate Wf. In one embodiment, the plating process is performed while rotating the substrate holder 440 by use of the rotation mechanism 448. Through the plating process, a conductive film (plating film) is precipitated on the surface to be plated Wf-a of the substrate Wf. In the present embodiment, real-time detection is made by the potential sensor 470 provided in the conduit 462 during the plating process. The control module 800 then measures the film thickness of the plating film based on the detection value by the potential sensor 470. Thereby, the change in film thickness of the plating film formed on the surface to be plated Wf-a of the substrate Wf in the plating process can be measured in real time.

Further, by performing the detection by the potential sensor 470 with the rotation of the substrate holder 440 (substrate Wf), the detection position by the sensor 470 can be changed, and film thicknesses at a plurality of points of the substrate Wf in the circumferential direction, or in the entire circumferential direction can be measured.

The plating module 400 may change a rotation speed of the substrate Wf by the rotation mechanism 448 during the plating process. As an example, the plating module 400 may slowly rotate the substrate Wf for the estimation of the plating film thickness by the film thickness estimation module. As an example, the plating module 400 may rotate the substrate Wf at a first rotation speed Rs1 during the plating process and rotate the substrate Wf at a second rotation speed Rs2 slower than the first rotation speed Rs1 while the substrate Wf rotates once or several times every predetermined period (for example, every few seconds). In this way, the plating film thickness of the substrate Wf can be estimated with high accuracy even when a sampling period by the potential sensor 470 is small with respect to the rotation speed of the substrate Wf. Here, the second rotation speed Rs2 may be set, for example, to a speed of one-tenth of the first rotation speed Rs1.

Thus, according to the plating apparatus 1000 of the present embodiment, by detecting the potential by the potential sensor 470 through the conduit 462 provided in the plating tank 410, the change in film thickness of the plating film during the plating process can be measured. With reference to the change in film thickness of the plating film thus measured, plating conditions can be adjusted including at least one selected from a plating current value, a plating time, the opening dimension of the anode mask 426, and the position of the shielding body 480 in and after the next plating process. The plating conditions may be adjusted by a user of the plating apparatus 1000 or by the control module 800. As an example, the adjustment of the plating conditions by the control module 800 may be performed, for example, based on a conditional expression or a program predetermined by experiments or the like.

Figure 6:
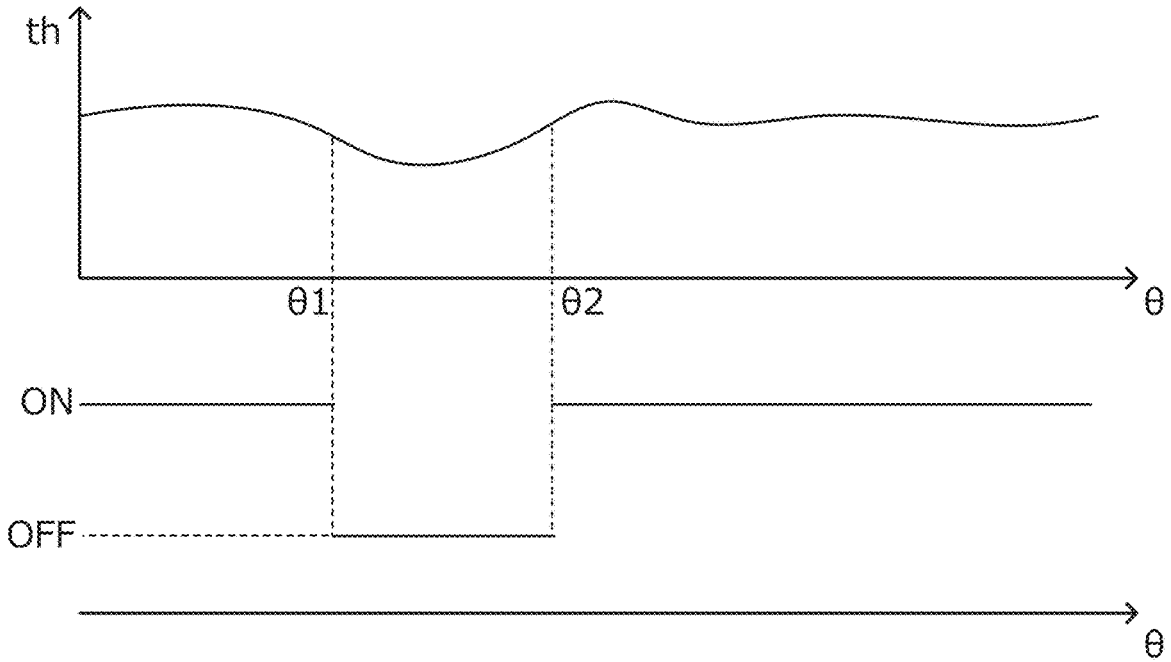
FIG. 6 illustrates an example of adjustment of a position of the shielding body during a plating process as an example of adjustment of plating conditions by a control module.

The adjustment of the plating conditions may be performed when plating another substrate Wf, or the plating conditions in the current plating process may be adjusted in real time. As an example, the control module 800 may adjust the position of the shielding body 480. FIG. 6 illustrates an example of adjustment of the position of the shielding body 480 during the plating process as an example of the adjustment of the plating conditions by the control module 800. In the example illustrated in FIG. 6, a predetermined detection point Sp (see FIG. 5) near an outer periphery of the substrate Wf is detected by the potential sensor 470 with the rotation of the substrate Wf, thereby measuring the change in film thickness of the substrate Wf in the circumferential direction (see a single dotted chain line in FIG. 5). FIG. 6 illustrates, in an upper stage, the change in film thickness with a circumferential position □ along a horizontal axis and a film thickness th along a vertical axis. In the example illustrated in FIG. 6, the film thickness th of the plating film formed in a region of □1 to □2 is smaller than in other regions. In this case, the control module 800 may adjust the position of the shielding body 480 with the rotation of the substrate Wf so that the shielding body 480 moves to the retracted position in the region of □1 to □2, having a small film thickness th ("OFF" in FIG. 6), and the shielding body 480 moves to the shielding position in the other regions ("ON" in FIG. 6). Thereby, an amount of plating formed in the region of □1 to □2 can be increased, to improve uniformity of the plating film formed on the substrate Wf.

The control module 800 may adjust a distance between the substrate Wf and the resistor 450 as a real-time adjustment of the plating conditions. According to research by the present inventors, it has been found that the distance between the substrate Wf and the resistor 450 comparatively noticeably affects the amount of plating formed near the outer periphery of the substrate Wf and that the distance does not comparatively affect the amount of plating formed in a central region of the substrate Wf. For this reason, as an example, when the film thickness of the plating film near the outer periphery is larger than a target, the control module 800 can reduce the distance between the substrate Wf and the resistor 450, and when the film thickness of the plating film near the outer periphery is smaller than the target, the control module can increase the distance between the substrate Wf and the resistor 450. The longer the shielding body 480 is in the shielding position, the control module 800 may increase the distance between the substrate Wf and the resistor 450, and the shorter the shielding body 480 is in the shielding position, the control module may reduce the distance between the substrate Wf and the resistor 450. In this way, the amount of plating formed near the outer periphery of the substrate Wf can be adjusted, to improve the uniformity of the plating film formed on the substrate Wf. As an example, the control module 800 can drive the elevating/lowering mechanism 442, to adjust the distance between the substrate Wf and the resistor 450. However, without being limited to such examples, the control module 800 may adjust the distance between the substrate Wf and the resistor 450 by moving the resistor 450 with the drive mechanism 452.

Further, the control module 800 may adjust the opening dimension of the anode mask 426 as the real-time adjustment of the plating conditions. As an example, when the film thickness of the plating film near the outer periphery is larger than the target, the control module 800 may reduce the opening dimension of the anode mask 426, and when the film thickness of the plating film near the outer periphery is smaller than the target, the control module may increase the opening dimension of the anode mask 426.

Second Embodiment

Figure 7:
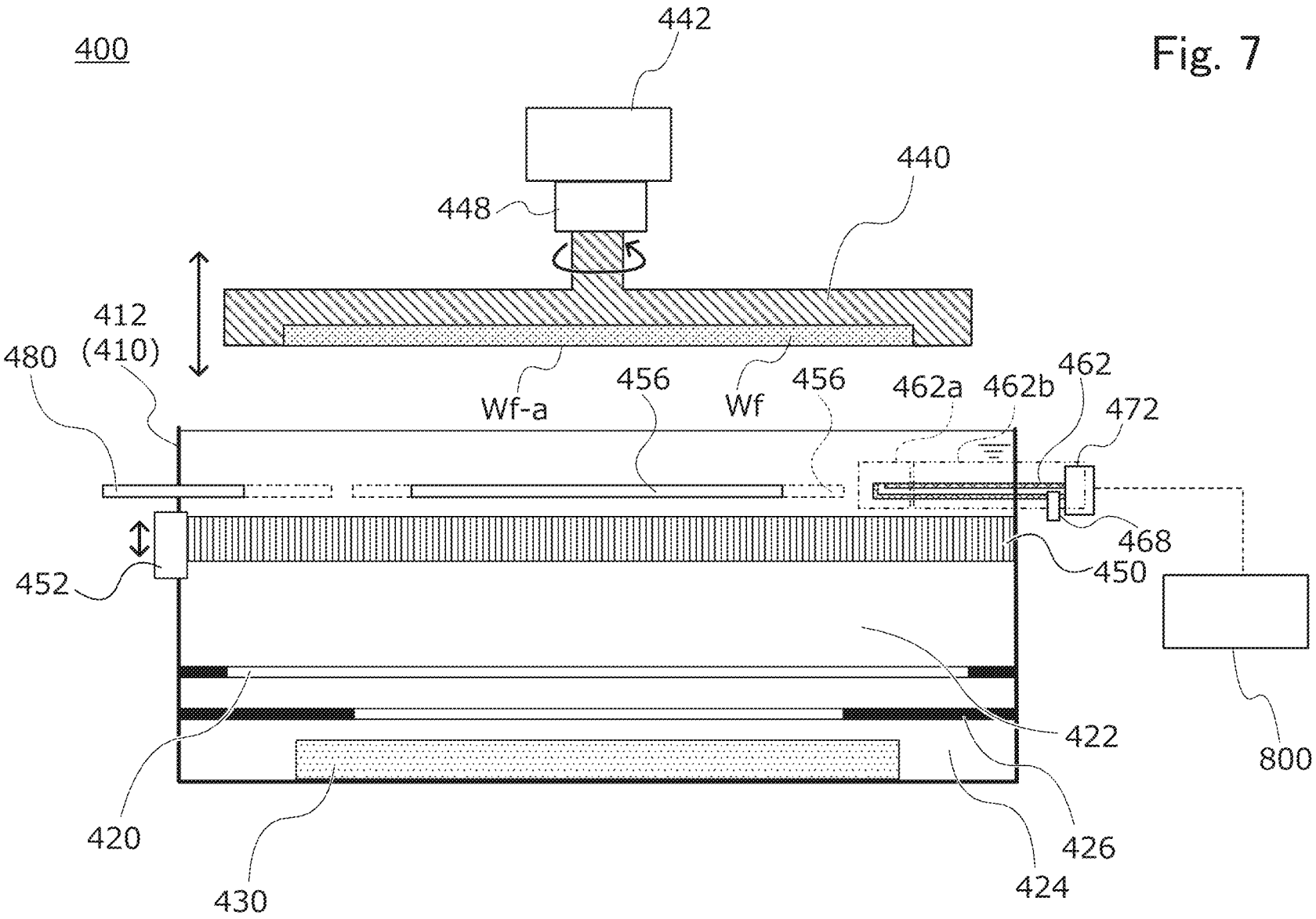
FIG. 7 is a longitudinal sectional view schematically illustrating a configuration of a plating module according to a second embodiment.

FIG. 7 is a longitudinal sectional view schematically illustrating a configuration of a plating module according to a second embodiment. A portion of a plating module 400 according to the second embodiment that overlaps with the portion of the plating module 400 according to the first embodiment is denoted with the same reference sign and is not described. In the plating module 400 of the second embodiment, a conduit 462 is disposed in a plating tank 410 in the same manner as in the plating module 400 of the first embodiment, and a second portion 462*b* of the conduit 462 is provided with an auxiliary anode 472 in place of the potential sensor 470. Alternatively, the plating module 400 may include a first conduit 462 provided with the auxiliary anode 472 and a second conduit 462 provided with the potential sensor 470. In this case, although not limited to, an opening end 462*a* of the first conduit 462 and an opening end 462*a* of the second conduit 462 are preferably arranged at the same distance from a center of a substrate Wf. The plating module 400 may include a plurality of sets, each set including the first conduit 462 provided with the auxiliary anode 472 and the second conduit 462 provided with the potential sensor 470.

The auxiliary anode 472 is configured to apply a voltage between the anode and the substrate Wf through a plating solution in the conduit 462. Here, when the voltage is applied between the auxiliary anode 472 and the substrate Wf, a current flows mainly through a surface to be plated Wf-a in the vicinity of an opening end 464 of the conduit 462. Therefore, by using the auxiliary anode 472, precipitation of a conductive film (plating film) can be promoted in a local region in the vicinity of the opening end 464. In particular, by using the auxiliary anode 472 with rotation of a substrate holder 440 (substrate Wf), the control module 800 can promote the precipitation of the plating film locally in a region where the plating film is slowly formed (film thickness is small), and uniformity of the plating film formed on the substrate Wf can be improved.

Figure 8:
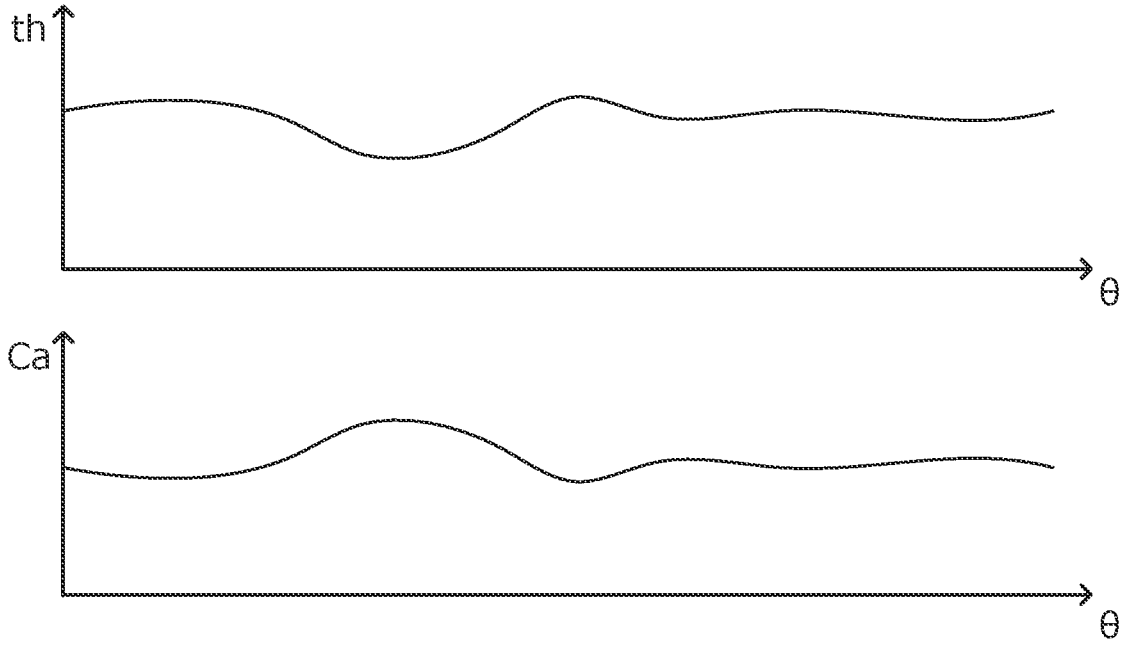
FIG. 8 illustrates an example of adjustment of a current flowing through an auxiliary anode during a plating process as an example of adjustment of the plating conditions by the control module.

FIG. 8 illustrates an example of adjustment of the current flowing through the auxiliary anode 472 during the plating process as an example of adjustment of plating conditions by a control module 800. In the example illustrated in FIG. 8, as in the example illustrated in FIG. 6, an upper stage illustrates a change in film thickness with a circumferential position □ along a horizontal axis and a film thickness th along a vertical axis. As an example, the control module 800 adjusts the voltage applied between the auxiliary anode 472 and the substrate Wf so that a larger current flows through the auxiliary anode 472 in a region where the film thickness th is smaller, and the uniformity of the plating film formed on the substrate Wf can be improved. In the second embodiment, the control module 800 preferably takes, into consideration, the formation of the plating film by the auxiliary anode 472 when estimating the plating film thickness. Thereby, estimation accuracy of the plating film thickness formed on the substrate Wf can be improved.

<Modification>

Figure 9:
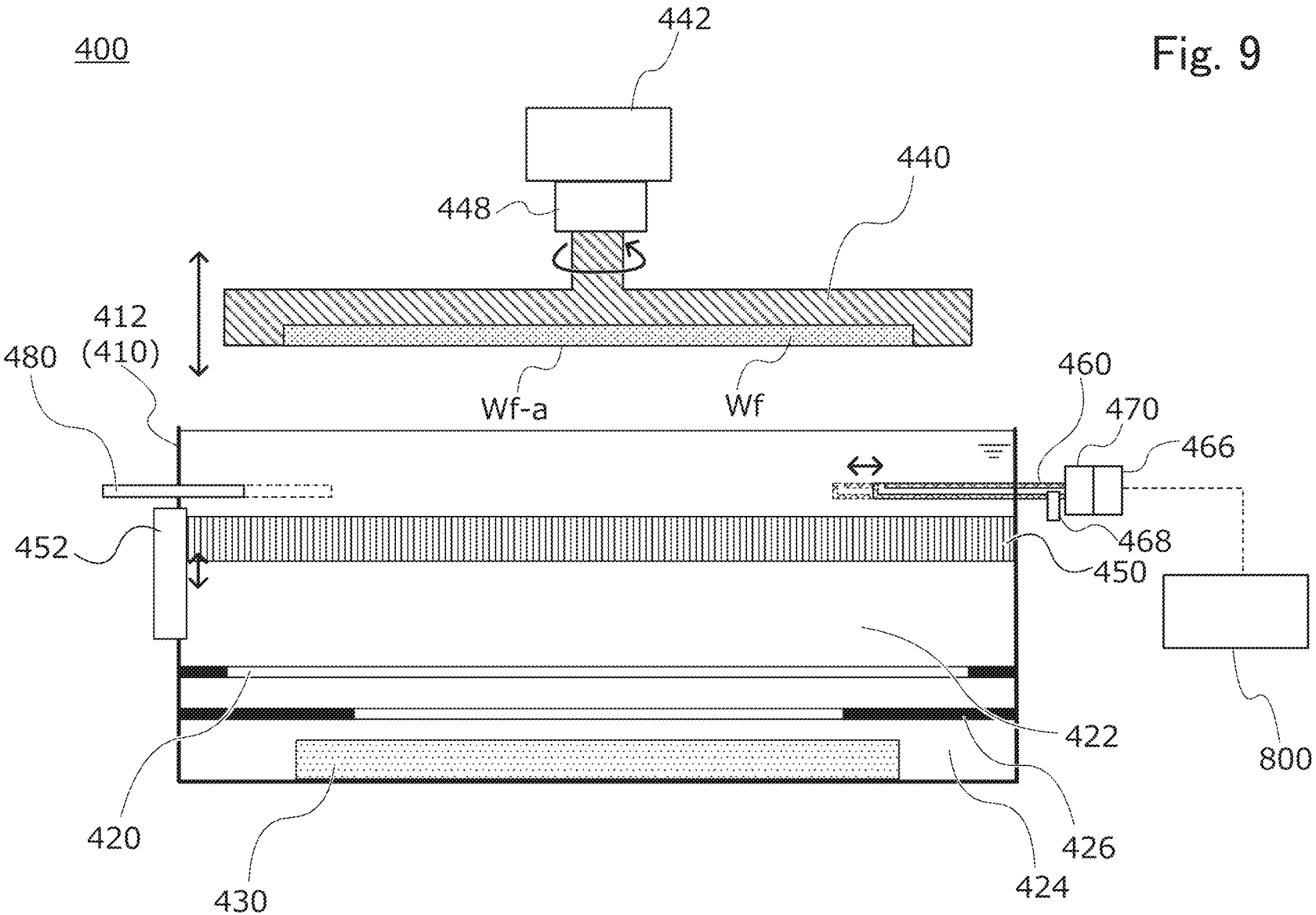
FIG. 9 is a longitudinal sectional view schematically illustrating a configuration of a plating module according to a modification of the first embodiment.

FIG. 9 is a longitudinal sectional view schematically illustrating a configuration of a plating module according to a modification of the first embodiment. A portion of a plating module 400 according to the modification that overlaps with the portion of the plating module 400 according to the first embodiment is denoted with the same reference sign and is not described. In the plating module 400 of the modification, a conduit 462 is configured to be movable by a drive mechanism 466. The drive mechanism 466 is controlled by a control module 800 and can adjust a position of an opening end 464 of the conduit 462. The drive mechanism 466 can be achieved with a known mechanism such as a motor or solenoid. As described above, the potential in the conduit 462 that is detected by the potential sensor 470 is approximately equal to the potential in the vicinity of the opening end 464, and hence the drive mechanism 466 can change a pseudo detection position by the potential sensor 470 by adjusting the position of the opening end 464 of the conduit 462. Although not limited to, the drive mechanism 466 may be configured to move the potential sensor 470 along a radial direction of a substrate Wf. In the example illustrated in FIG. 9, the potential sensor 470 is provided in the conduit 462. Alternatively, as described in the second embodiment, an auxiliary anode 472 may be provided in the conduit 462. In this way, the position of the opening end 464 of the conduit 462 is adjusted with the drive mechanism 466, so that a location on a surface to be plated Wf-a, on which a voltage from the auxiliary anode 472 acts, can be adjusted.

Third Embodiment

Figure 10:
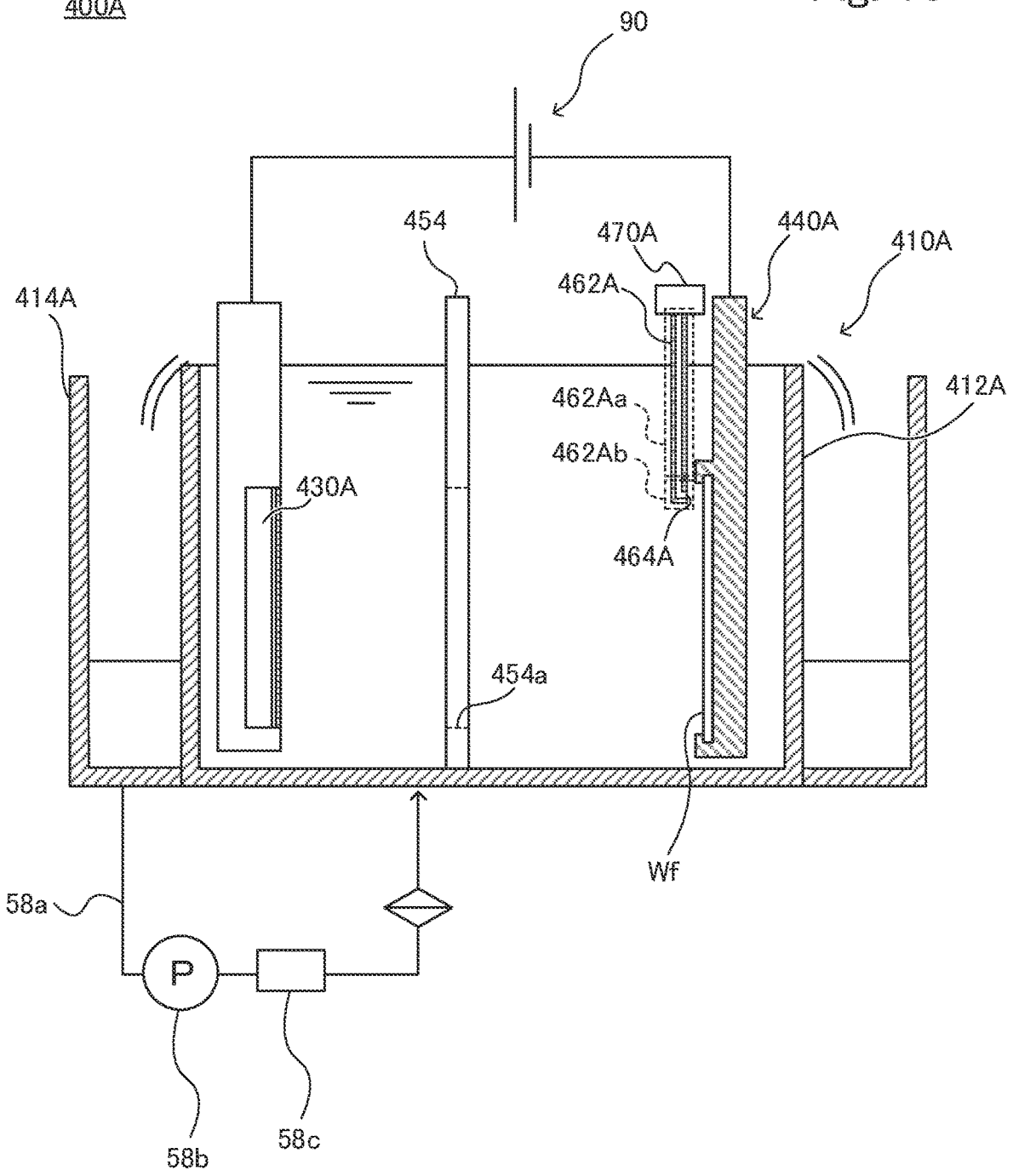
FIG. 10 is a longitudinal sectional view schematically illustrating a configuration of a plating module according to a third embodiment.

FIG. 10 is a longitudinal sectional view schematically illustrating a configuration of a plating module 400A of a third embodiment. In the third embodiment, a substrate Wf is held to extend in a vertical direction, that is, to have a plate surface facing horizontally. As illustrated in FIG. 10, the plating module 400A includes a plating tank 410A that holds a plating solution inside, an anode 430A disposed in the plating tank 410A, and a substrate holder 440A. In the third embodiment, a rectangular substrate is described as an example of the substrate Wf, and examples of the substrate Wf include the rectangular substrate and a circular substrate in the same manner as in the first embodiment.

The anode 430A is disposed to oppose the plate surface of the substrate Wf in the plating tank. The anode 430A is connected to a positive electrode of a power supply 90, and the substrate Wf is connected to a negative electrode of the power supply 90 via the substrate holder 440A. When a voltage is applied between the anode 430A and the substrate Wf, a current flows through the substrate Wf, and a metal film is formed on the surface of the substrate Wf in the presence of the plating solution.

The plating tank 410A includes an inner tank 412A in which the substrate Wf and the anode 430A are arranged, and an overflow tank 414A adjacent to the inner tank 412A. The plating solution in the inner tank 412A overflows a side wall of the inner tank 412A to flow into the overflow tank 414A.

One end of a plating solution circulation line 58*a* is connected to a bottom of the overflow tank 414A, and the other end of the plating solution circulation line 58*a* is connected to a bottom of the inner tank 412A. To the plating solution circulation line 58*a*, a circulation pump 58*b*, a constant temperature unit 58*c* and a filter 58*d* are attached. The plating solution overflows the side wall of the inner tank 412A to flow into the overflow tank 414A and is further returned to a plating solution storage tank 52 through the plating solution circulation line 58*a* from the overflow tank 414A. Thus, the plating solution circulates between the inner tank 412A and the overflow tank 414A through the plating solution circulation line 58*a*.

The plating module 400A further includes a regulation plate 454 that regulates a potential distribution on the substrate Wf. The regulation plate 454 is disposed between the substrate Wf and the anode 430A and has an opening 454*a* for limiting an electric field in the plating solution.

The plating module 400A is provided with a conduit 462A in the plating tank 410A. The conduit 462A can be, as an example, made of a resin such as polypropylene (PP) or polyvinyl chloride (PVC). The conduit 462A, in the same manner as the conduit 462 of the above embodiments, includes a first portion 462Ab including an opening end 464A disposed in a region between the substrate Wf and the anode 430A, and a second portion 462Aa disposed in a region apart from the region between the substrate Wf and the anode 430A. Further, a potential sensor 470A is provided in the second portion 462Aa of the conduit 462A. A detection signal by the potential sensor 470A is inputted into a control module 800A.

In the plating module 400A in this third embodiment, real-time detection by the potential sensor 470A can be performed during a plating process in the same manner as in the plating module 400 of the first embodiment. Then, the control module 800A measures a film thickness of a plating film based on a detection value by the potential sensor 470A. Thereby, a change in film thickness of the plating film formed on a surface to be plated of the substrate Wf can be measured in real time in the plating process. The control module 800A can also adjust plating conditions based on the film thickness of the plating film, in the same manner as in the first embodiment.

Also, in the plating module 400A of the third embodiment, an auxiliary anode 472 may be provided in the conduit 462A in place of the potential sensor 470A. Thereby, the plating conditions can be adjusted using the auxiliary anode 472 in the same manner as in the second embodiment. The plating module 400A may include one or more sets, each set including a first conduit 462A provided with the auxiliary anode 472 and a second conduit 462A provided with the potential sensor 470A. Furthermore, the conduit 462 may be configured to be movable by the drive mechanism 466.

This application is based on and claims the benefit of priority of Japanese Patent Application No. 2022-30876 filed on Mar. 1, 2022, and all disclosures, including a description, claims, drawings and an abstract of Japanese Patent Application No. 2022-30876 are incorporated herein by reference as a whole. All disclosures, including descriptions, claims, drawings and abstracts of Japanese Patent Laid-Open No. 2008-19496 (PTL 1) and Japanese Patent Laid-Open No. 2002-105695 (PTL 2) are incorporated herein by reference as a whole.

The present invention can be described in the following aspects.

[Aspect 1] According to Aspect 1, a plating apparatus is provided, and the plating apparatus includes a plating tank, a substrate holder that holds a substrate, an anode disposed in the plating tank to oppose the substrate held by the substrate holder, a conduit having a first portion including an opening end disposed in a region between the substrate held by the substrate holder and the anode, and a second portion apart from the region between the substrate held by the substrate holder and the anode, the conduit having at least a part filled with a plating solution, and a potential sensor that is disposed outside the region of the conduit and that is configured to measure a potential of the plating solution.

According to Aspect 1, the potential of the plating solution in the plating tank during a plating process can be measured. This can improve uniformity of a plating film formed on the substrate.

[Aspect 2] According to Aspect 2, a plating apparatus is provided, and the plating apparatus includes a plating tank, a substrate holder that holds a substrate, an anode disposed in the plating tank to oppose the substrate held by the substrate holder, a conduit having a first portion including an opening end disposed in a region between the substrate holder and the anode in the plating tank, and a second portion apart from the region between the substrate holder and the anode, the conduit having at least a part filled with a plating solution, and an auxiliary anode disposed in the second portion of the conduit.

According to Aspect 2, uniformity of a plating film formed on the substrate can be improved using the auxiliary anode disposed in the conduit.

[Aspect 3] According to Aspect 3, in Aspect 1 or 2, the opening end of the conduit faces a surface to be plated of the substrate held by the substrate holder.

[Aspect 4] According to Aspect 4, in Aspects 1 to 3, the plating apparatus further includes a resistor disposed between the anode and the substrate held by the substrate holder, and the opening end of the conduit is disposed between the resistor and the substrate.

[Aspect 5] According to Aspect 5, in Aspects 1 to 4, the second portion of the conduit extends outside the plating tank.

[Aspect 6] According to Aspect 6, in Aspects 1 to 5, the plating apparatus further includes a paddle disposed between the substrate held by the substrate holder and the anode, and a paddle stirring mechanism that moves the paddle to stir the plating solution, and the first portion of the conduit is disposed on an outer peripheral side of the paddle.

[Aspect 7] According to Aspect 7, in Aspect 1, the plating apparatus further includes a control module configured to estimate a distribution of a plating current in the substrate during a plating process based on a detection signal by the potential sensor.

[Aspect 8] According to Aspect 8, in Aspect 7, the control module is configured to estimate a film thickness distribution of the plating film in the substrate based on the estimated distribution of the plating current in the substrate.

[Aspect 9] According to Aspect 9, in Aspects 1, 7 and 8, the plating apparatus further includes a control module that adjusts plating conditions based on a detection signal of the potential sensor during a plating process.

[Aspect 10] According to Aspect 10, in Aspects 1 to 9, the plating apparatus further includes a rotation mechanism that rotates the substrate holder.

[Aspect 11] According to Aspect 11, in Aspects 1 to 10, the substrate holder is configured to hold the substrate with a surface to be plated being oriented downward in the plating tank.

[Aspect 12] According to Aspect 12, in Aspects 1 to 10, the substrate holder is configured to hold the substrate with a surface to be plated being oriented laterally in the plating tank.

The embodiments of the present invention have been described above, and the above embodiments of the present invention are described to facilitate understanding of the present invention and are not intended to limit the present invention. Needless to say, the present invention may be changed or modified without departing from the spirit, and the present invention includes equivalents to the invention. Also, in a range in which at least some of the above-described problems can be solved or a range in which at least some of effects are exhibited, any arbitrary combination of the embodiment and the modification is possible, and arbitrary combination or omission of respective constituent components described in claims and description is possible.

REFERENCE SIGNS LIST

400, 400A plating module
410, 410A plating tank
420 membrane
426 anode mask
430, 430A anode
440, 440A substrate holder
442 elevating/lowering mechanism
448 rotation mechanism
450 resistor
452 drive mechanism
454 regulation plate
456 paddle
462 conduit
462*a* first portion
462*b* second portion
464 opening end
466 drive mechanism
468 filling mechanism
470, 470A potential sensor
472 auxiliary anode
480 shielding body
800, 800A control module
1000 plating apparatus
Wf substrate
Wf-a surface to be plated

What is claimed is:

1. A plating apparatus comprising:
a plating tank;
a substrate holder that holds a substrate;
an anode disposed in the plating tank to oppose the substrate held by the substrate holder;
a conduit having a first portion including an opening end disposed in a region between the substrate held by the substrate holder and the anode, and a second portion apart from the region between the substrate held by the substrate holder and the anode, the conduit having at least a part filled with a plating solution;
a first detection electrode that is a potential sensor disposed in the second portion of the conduit, and configured to measure a potential of the plating solution;
a second detection electrode that is a potential sensor for reference, the second detection electrode disposed at a second position and configured to measure potential of the plating solution outside of a region between the substrate and the anode as compared to the opening end in the plating tank; and
a control module that measures a potential difference between the first detection electrode and the second detection electrode, to estimate a thickness of a plating film on the substrate based on the potential difference.

2. The plating apparatus according to claim 1, wherein the opening end of the conduit faces a surface to be plated of the substrate held by the substrate holder.

3. The plating apparatus according to claim 1, further comprising:

a resistor disposed between the anode and the substrate held by the substrate holder, wherein the opening end of the conduit is disposed between the resistor and the substrate.

4. The plating apparatus according to claim 1, wherein the second portion of the conduit extends outside the plating tank.

5. The plating apparatus according to claim 1, further comprising:

a paddle disposed between the substrate held by the substrate holder and the anode, and a paddle stirring mechanism that moves the paddle to stir the plating solution, wherein the first portion of the conduit is disposed on an outer peripheral side of the paddle.

6. The plating apparatus according to claim 1, further comprising:

the control module configured to estimate a distribution of a plating current in the substrate during a plating process based on the potential difference between the first detection electrode and the second detection electrode.

7. The plating apparatus according to claim 6, wherein the control module is configured to estimate a film thickness distribution of the plating film in the substrate based on the estimated distribution of the plating current in the substrate.

8. The plating apparatus according to claim 1, further comprising:

a control module that adjusts plating conditions during a plating process based on the potential difference between the first detection electrode and the second detection electrode.

9. The plating apparatus according to claim 1, further comprising:

a second conduit having a third portion including an opening end disposed in a region between the substrate holder and the anode in the plating tank, and a fourth portion apart from the region between the substrate holder and the anode, the second conduit having at least a part filled with the plating solution, and an auxiliary anode disposed in the fourth portion of the second conduit.

10. The plating apparatus according to claim 1, further comprising:

a rotation mechanism that rotates the substrate holder.

11. The plating apparatus according to claim 1, wherein the substrate holder is configured to hold the substrate with a surface to be plated being oriented downward in the plating tank.

12. The plating apparatus according to claim 1, wherein the substrate holder is configured to hold the substrate with a surface to be plated being oriented laterally in the plating tank.

* * * * *